US009241561B2

(12) United States Patent
Feng

(10) Patent No.: US 9,241,561 B2
(45) Date of Patent: Jan. 26, 2016

(54) ATTACHABLE CUP FOR TOOTHBRUSH

(71) Applicant: Shin Feng, Rowland Heights, CA (US)

(72) Inventor: Shin Feng, Rowland Heights, CA (US)

( * ) Notice: Subject to any disclaimer, the term of this patent is extended or adjusted under 35 U.S.C. 154(b) by 99 days.

(21) Appl. No.: 13/936,210

(22) Filed: Jul. 8, 2013

(65) Prior Publication Data

US 2015/0013096 A1 Jan. 15, 2015

(51) Int. Cl.

*A46B 17/00* (2006.01)
*A46B 17/08* (2006.01)
*A47G 19/22* (2006.01)

(52) U.S. Cl.

CPC ..... *A46B 17/08* (2013.01); *A47G 19/22* (2013.01); *A46B 2200/1066* (2013.01)

(58) Field of Classification Search

CPC ..... A46B 17/02
USPC ..... 220/736, 735, 737, 475; 248/688, 689, 248/690, 691, 692, 693
See application file for complete search history.

(56) References Cited

U.S. PATENT DOCUMENTS 2,140,231 A * 12/1938 Jefferis ..... A45D 29/22 132/73
3,101,857 A * 8/1963 Freedman ..... A47G 7/047 215/396
5,320,249 A * 6/1994 Strech ..... B65D 81/3876 220/739
5,664,711 A * 9/1997 Mellon ..... A45D 29/22 132/73
5,881,734 A * 3/1999 Trayes ..... A45D 34/00 132/73
6,202,963 B1 * 3/2001 Derman ..... A46B 17/02 206/228
7,810,783 B2 * 10/2010 Tsay ..... B62D 1/043 224/276
8,757,573 B1 * 6/2014 Barnes, Jr. ..... A47G 23/0225 220/737
2002/0036206 A1 * 3/2002 Bergman ..... B44D 3/12 220/754
2002/0185509 A1 * 12/2002 Wichman ..... A45F 5/00 224/677
2004/0079843 A1 * 4/2004 Medwed ..... A61J 9/06 248/104
2005/0000971 A1 * 1/2005 Koumarianos ..... B44D 3/123 220/736
2012/0152969 A1 * 6/2012 Ates ..... A47G 21/16 220/735
2012/0160989 A1 * 6/2012 Yasuhara ..... A63B 33/002 248/693

* cited by examiner

*Primary Examiner* — Steven A. Reynolds
*Assistant Examiner* — King M Chu

(57) ABSTRACT

An attachable cup includes a container and an attachable device for a toothbrush, and the attachable device includes at least one part of the container. An attachable device is for attaching a container to a toothbrush. The attachable device uses a fastening method, a gripping method, a clamping method, a locking method or the like to attach the attachable cup to a toothbrush. Once the attachable device attaches the attachable cup to a toothbrush, the operator can use the attachable cup for oral rinsing.

5 Claims, 5 Drawing Sheets

ATTACHABLE CUP FOR TOOTHBRUSH

BACKGROUND OF THE INVENTION

1. Field of the Invention

The present invention relates to an attachable cup for toothbrush.

2. Description of the Related Art

In order to maintain good oral health, it is necessary to properly rinse the mouth after brushing the teeth.

In recent years, in order to rinse the mouth, U.S. Pat. No. 7,905,674 describes a toothbrush with a tunnel which receives a stream of water from a faucet, and the stream of water goes through the tunnel creating a fountain for the mouth. Also, U.S. Pat. No. 6,357,072 B1 describes a rinsing attachment for a toothbrush, including a sloped inner recessed surface area to create a fountain when a stream of water contacts therewith.

In order for the above arts to work, users need to adjust the flow of water correctly and position the device at a proper angle constantly to create a fountain, and then maintain a certain body posture so their mouth can contact the fountain of water to rinse.

SUMMARY OF THE INVENTION

It is an object of the present invention to provide an attachable cup for toothbrush which is easy to rinse a user's mouth without using a conventional drinking cup or wetting the hand. It is still another object of the present invention to provide an attachable cup for toothbrush which can be used continuously regardless of the life expectancy of the toothbrush.

In the present invention, an attachable cup includes a container and an attachable device for a toothbrush, and the attachable device includes at least one part of the container. An attachable device is for attaching a container to a toothbrush. The attachable device uses a fastening method, a gripping method, a clamping method, a locking method or the like to attach the attachable cup to a toothbrush. The above mentioned methods are not limitations as long as the attachable device attaches to a toothbrush.

In accordance with one aspect of the present invention, an attachable cup includes a container and an attachable device for toothbrush, and the attachable device includes at least one part of the container. The attachable device comprises a strap and a member for fastening the strap, and the member is part of the container.

In accordance with one aspect of the present invention, an attachable cup includes a container and an attachable device for toothbrush, and the attachable device includes at least one part of the container. The attachable device comprises a first clamping arm, a second clamping arm, a spring, and a shaft for clamping onto the toothbrush and the second clamping arm is part of the container.

In accordance with one aspect of the present invention, an attachable cup includes a container and an attachable device for toothbrush, and the attachable device includes at least one part of the container. The attachable device comprises a strap with locking steps and a member for fastening and then locking the strap. The member is part of the container.

In accordance with one aspect of the present invention, an attachable cup includes a container and an attachable device for toothbrush, and the attachable device includes at least one part of the container. The attachable device comprises a top extruding arm and a bottom extruding arm. The total number of the top extruding arm and the bottom are more than or equal to 3, and those are part of the container.

In accordance with one aspect of the present invention, an attachable cup for toothbrush includes a container and at least one member connected to the container in order to attach to a toothbrush.

In accordance with one aspect of the present invention, an attachable cup for toothbrush includes a container and at least one member connected to the container in order to attach to a toothbrush. The member is a strap and the container includes another member for fastening the strap.

In accordance with one aspect of the present invention, an attachable cup for toothbrush includes a container and at least one member connected to the container in order to attach to a toothbrush. The container includes a first clamping arm, and the member includes a second clamping arm, a spring and a shaft. The attachable cup is attached by clamping with the first clamping arm and the second clamping arm while the spring provides counterforce pushing the clamps together and the shaft enforces a constrained rotation for the first clamping arm and the second clamping arm during clamping.

In accordance with one aspect of the present invention, an attachable cup for toothbrush includes a container including an extension arm, and a strap connected with the container and including at least one hole. The extension arm includes an insert hole, width of which is wider than the width of the strap, and a member for hooking with one of the holes.

Although the capacity of the container is not particularly limited, it is preferable that it is more than or equal to 5 ml and less than or equal to 90 ml. More preferably, the capacity of the container is more than or equal to 5 ml and less than or equal to 35 ml.

Note that any shape of container can be used as long as it is able to attach to a toothbrush. The present invention can provide an attachable cup for toothbrush, which is easy to rinse a user's mouth without using a conventional drinking cup and wetting the hand.

Also, the present invention can provide an attachable cup for toothbrush which can be used continuously regardless of the life expectancy of the toothbrush.

DETAILED DESCRIPTION OF THE INVENTION

Figure 1:
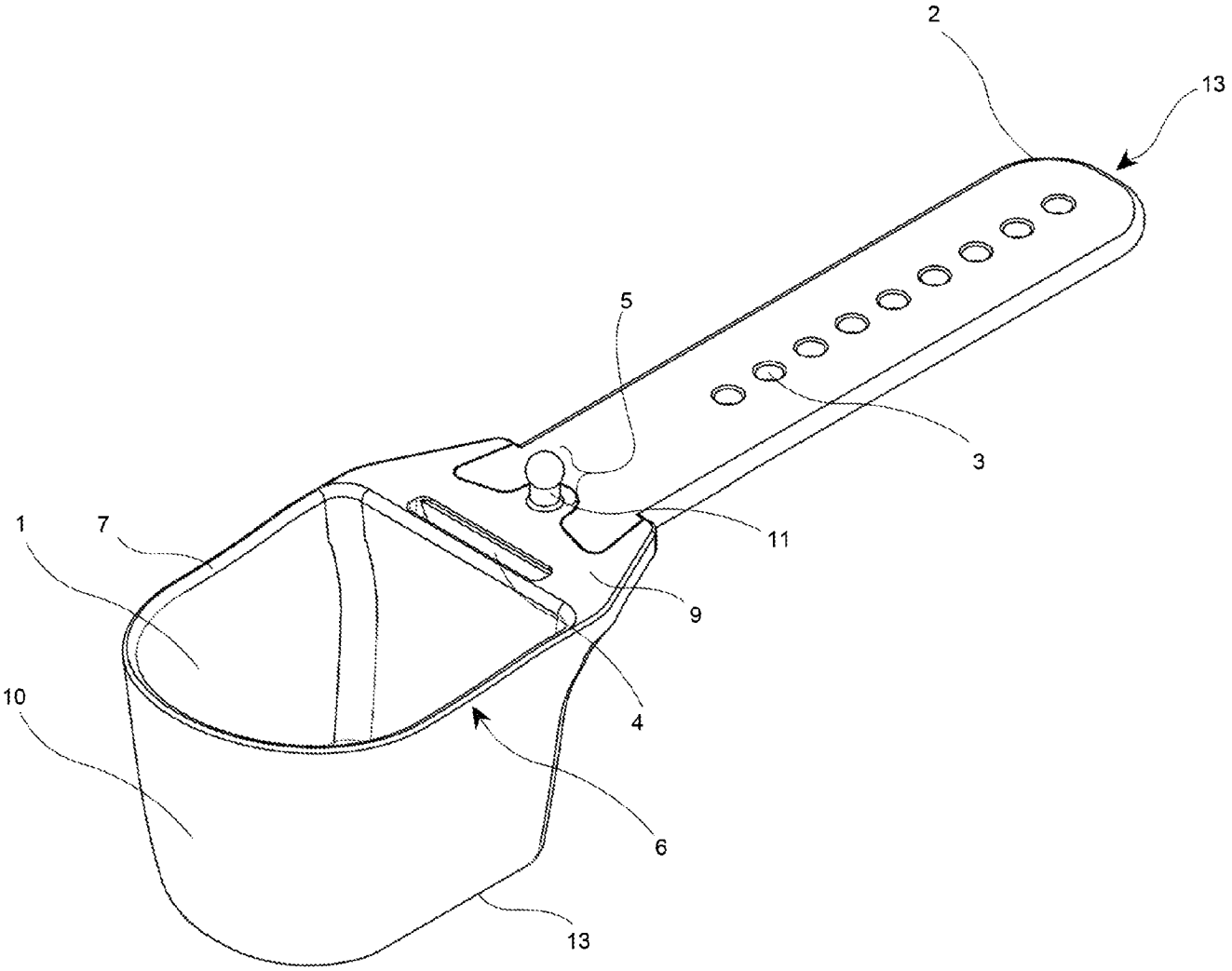
FIG. 1 is a view showing an example of an attachable cup for a toothbrush of the present invention.

Embodiment modes of the present invention will be explained hereinafter with reference to the accompanying drawings. However, the present invention is not limited to the explanation below, and it is easily understood by those skilled in the art that modes and details of the present invention can be modified in various ways without departing from the purpose and the scope of the present invention. Therefore, the present invention should be construed as being included therein. Note that, in the structure of the present invention which will be hereinafter explained, reference numerals denoting the same portions are used in common between drawings in some cases.

Embodiment Mode 1

An example of an attachable cup for toothbrush of the present invention is described with reference to FIG. 1. Also, a top view, a front view, a side view, a rear elevation, a bottom view of the attachable cup is shown in FIG. 3, FIG. 4, FIG. 5, FIG. 6 and FIG. 7, respectively. The attachable cup for toothbrush can be attached to a toothbrush 100 as shown in FIG. 2. The attachable cup for toothbrush shown in FIG. 1 includes a container 1, a strap 2 and an extension arm 9. The strap 2 includes at least one hole 3, and the extension arm 9 of the container 1 includes an insert hole 4 and cylindrical stud 5 in order to attach the attachable cup to a toothbrush with strap 2. The attachable cup can be attached to a toothbrush by fastening the strap 2 and then hooking the hole 3 of the strap 2 with the cylindrical stud 5 after passing the strap 2 through the insert hole 4. A member like a stabilizer sphere 11 which is bigger than the hole 3, is formed on the cylindrical stud 5 in order to hook the strap 2. Note that part of the attachable cup, which uses for attaching, is referred to as an attachable device 101, and the attachable device 101 includes at least one part of the container 1.

The toothbrush which includes a head 101, bristles 102, a neck 103, a mid-handle 104 and an end-handle 105 shown in FIG. 2 depicts a general toothbrush as only one example. A toothbrush which is attached by an attachable cup of the present invention is not limited to this. The attachable cup can be attached to any type of toothbrush including manual and electric ones, as well as any shapes and sizes. Needless to say, it can also be used for right-hand or left-hand toothbrush.

Although it is preferred to attach the attachable cup to the mid-handle 104 of a toothbrush when considering brushing and rinsing, there are no limit as to where the users wishes to attach the attachable cup onto the toothbrush.

The attachable cup of the present invention is attachable and releasable, so even if users throw away a toothbrush due to the end of life of its bristles 102, users can still continuously use the attachable cup. Thus, the attachable cup is very economical.

The container 1 can be made from synthetic resin such as polypropylene, polyethylene, polyethylene terephthalate, or silicone. Note that the materials are not limited to ones mentioned here. The manufacturing process for container 1 is made by injection molding, double injection molding, compression molding, vacuum forming, blow molding, rotational molding or the like.

Figure 5:
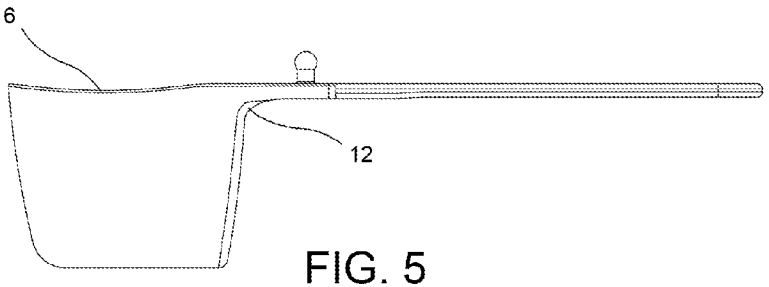
FIG. 5 is a side view showing the attachable cup illustrated in FIG. 1.
Figure 7:
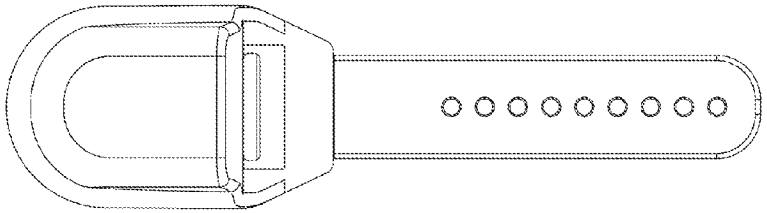
FIG. 7 is a bottom view showing the attachable cup illustrated in FIG. 1.
Figure 4:
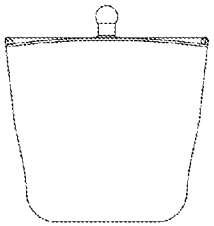
FIG. 4 is a front view showing the attachable cup illustrated in FIG. 1.
Figure 9:
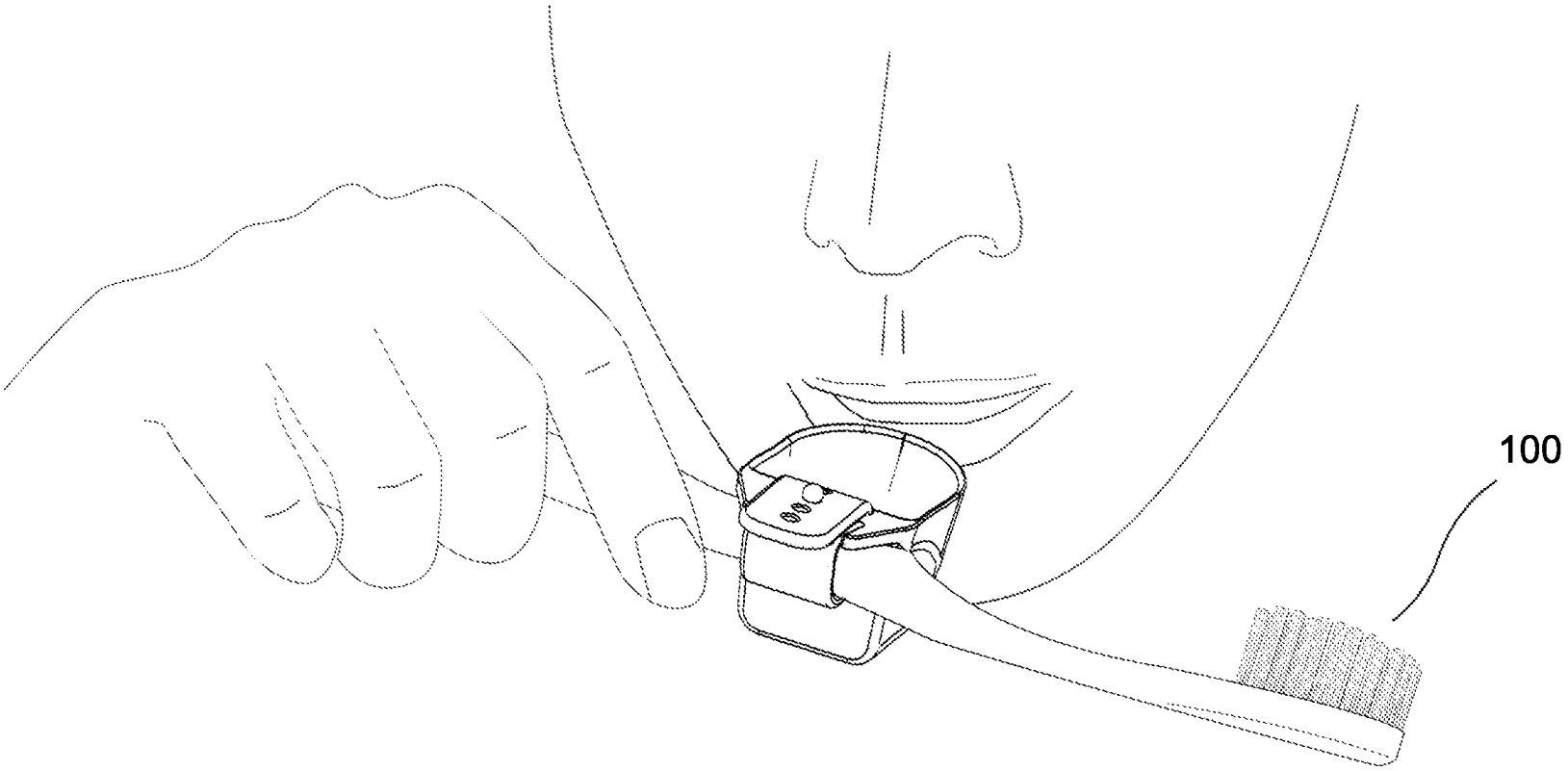
FIG. 9 illustrates one of the ways on how to use the attachable cup by a human being.

Since container 1 is used as an rinsing cup shown in FIG. 9, it is preferable to be formed with an upper lip rest 6 and an inner edge lip 7 on the upper edge of the container 1 for contacting the user's mouth when rinsing. Also, it is preferable that the lateral front of the container 1 facing the extension arm 9 has an arc shape to provide an easier access to water for the mouth. Also, it is preferable that the cross-section of the container 1 has a predetermined draft angle with a smaller bottom and a bigger top. Please note that the shape of container 1 is not limited to this. As shown in FIG. 5, an extension arm support ribs 12 are formed under the extension arm 9 included in the container 1. This helps to prevent the extension arm 9 from breaking easily.

Although the capacity of the container 1 is not particularly limited, it is preferable that it is more than or equal to 5 ml and less than or equal to 90 ml. More preferably, the capacity of the container 1 is more than or equal to 5 ml and less than or equal to 35 ml.

The strap 2 can be made from silicone, rubber or the like; for example, silicone rubber. The strap 2 is made by extrusion, injection molding, double injection molding, liquid injection molding, compression molding, rotational molding, calendaring or the like.

The container 1 and strap 2 are made, and then combined by oil press, gluing or the like. The attaching process of the attachable cup shown in FIG. 1 involves the strap end 13 pass around the toothbrush and through the insert hole 4, then the strap end 13 is pulled and the strap 2 starts to tighten around the toothbrush similar to the way a person tightens his or her belt around the waist line. Once the desired tightness is achieved, one of the hole 3 will be inserted with the cylindrical stud 11.

Therefore, the attachable cup is attachable with fastening and the attachable way is referred to as a fastening method and the attachable cup is attached to toothbrush by the attachable device 101 with the fastening method.

Any shape of container 1 can be used as long as it is able to attach to a toothbrush with using a strap 2 and so on.

By using an attachable cup for toothbrush of the present invention, it is easy for user to rinse his or her mouth without using a conventional drinking cup, wetting their hand, or place their head close to the faucet.

Embodiment Mode 2

This embodiment mode will describe attachable cups, which are different from that in Embodiment Mode 1, with reference to FIG. 8.

Figure 8C:
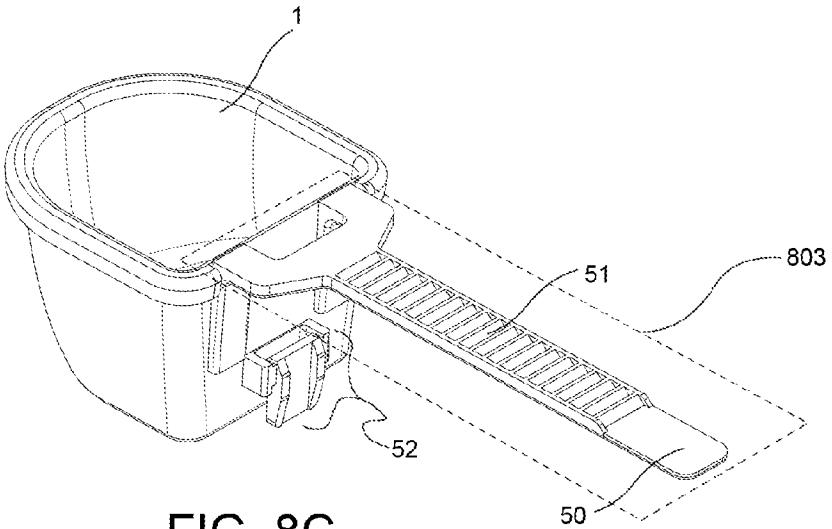
FIG. 8C is a view showing one example of an attachable cup for a toothbrush of the present invention.
Figure 8B:
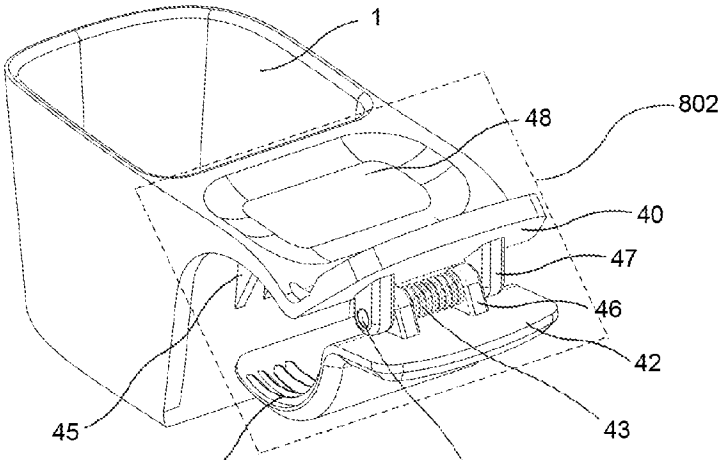
FIG. 8B is a view showing one example of an attachable cup for a toothbrush of the present invention.
Figure 8A:
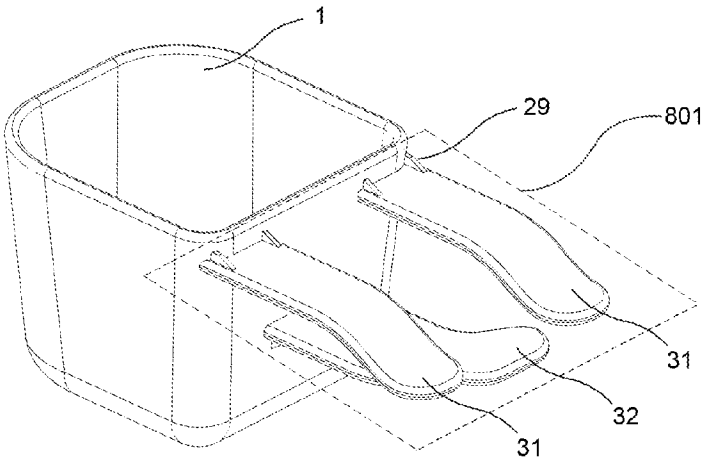
FIG. 8A is a view showing one example of an attachable cup for a toothbrush of the present invention.

An attachable cup for toothbrush shown in FIG. 8A attaches to a toothbrush by gripping with a top extruding arm 31 and a bottom extruding arm 32, which are part of the container 1. Note that there are two top extruding arms 31 and one bottom extruding arm 32 described in FIG. 8A, however the total number of the top extruding arm 31 and the bottom extruding arm 32 may be more than or equal to 3, by reason of the additional number will make the attachable cup more stable.

It is preferable to form ribs 29 between top, bottom extruding arms 31, 32, and the container 1, in order to prevent these arms from breaking off easily. The attachable cup shown in FIG. 8A is one piece, thus the manufacture process is easy and economical. The attachable cup is attachable with gripping and the attachable way is referred to as a gripping method and the attachable cup is attached to a toothbrush by an attachable device 801 with the gripping method.

An attachable cup for toothbrush shown in FIG. 8B includes a container 1, a clamping arm 42, a spring 43 and a shaft 44, and the container 1 includes an extension arm 40. In order to support the shaft 44, two support legs 46 are formed on the clamping arm 42 and two support legs 47 are formed on the extension arm 40. The clamping arm 42 can be made from the same kinds of materials as the container 1. The extension arm 40 also works as the other clamping arm, so it is preferable that the material of the clamping arm 42 is the same as that of the container 1. The attachable cup is attached by clamping with the extension arm 40 and the clamping arm 42 while the spring 43 provides counterforce which pushes the clamps together and the shaft 44 enforces a constrained rotation for the extension arm 40 and the clamping arm 42 during clamping. The extension arm 40, the clamping arm 42, the spring 43 and the shaft 44 function as an attachable device 802. The attachable cup is attachable by clamping so the attachable way is referred to as a clamping method and the attachable device 802 attaches the attachable cup to a toothbrush with the clamping method.

In order to attach to a toothbrush stably, the handle ribs 45 are formed under the extension arm 40 and the clamping arm 42 of the attachable cup in FIG. 8B. The handle ribs 45 of the extension arm 40 help to prevent the extension arm 40 from breaking easily as well. Also, a recessed portion is formed on the extension arm 40, which acts as a thumb rest 48 when user attaches the attachable cup to the mid-handle of the toothbrush. It allows users to rest their thumb on the thumb rest 48 when brushing their teeth.

Figure 2:
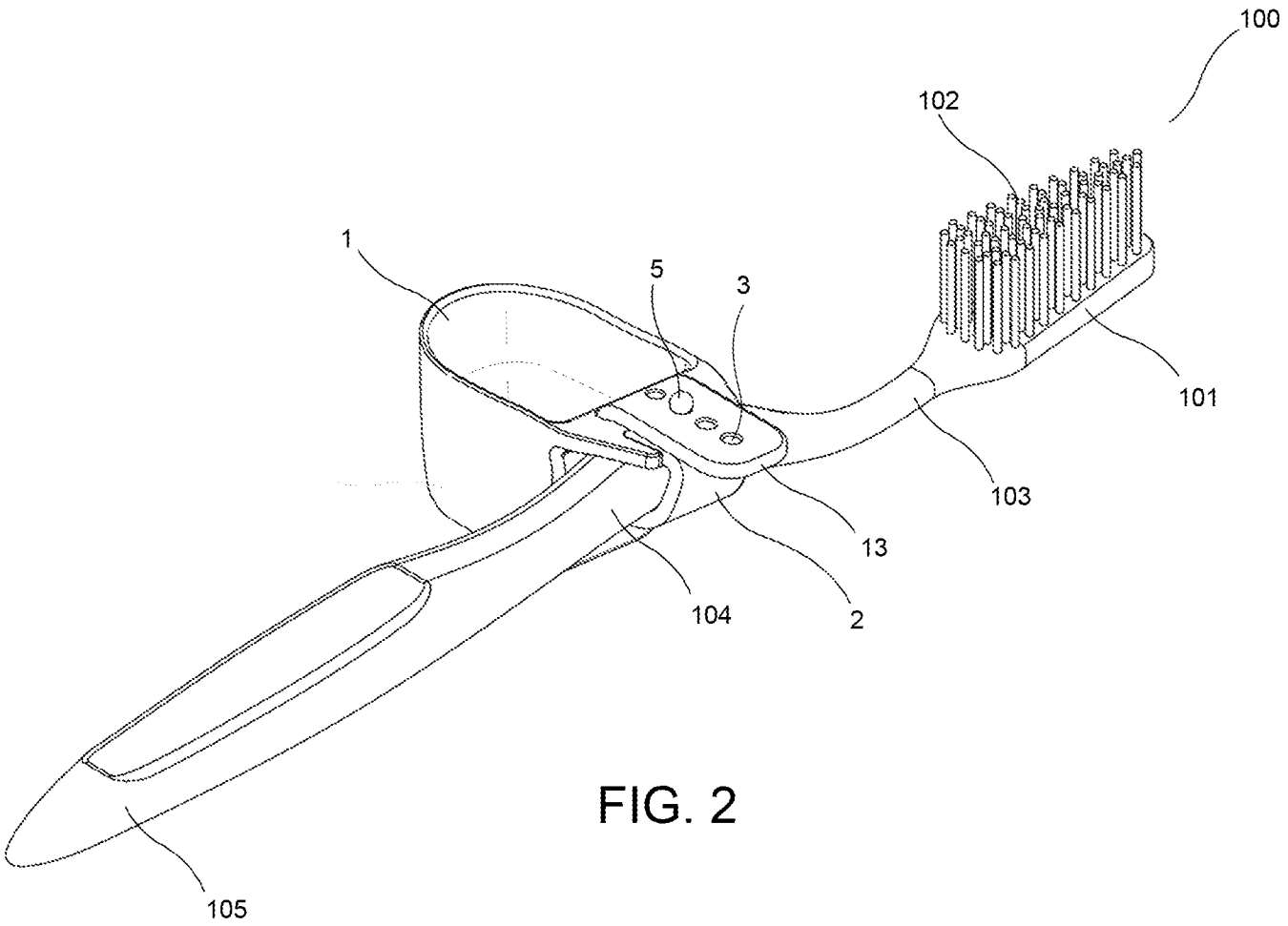
FIG. 2 is a view showing the attachable cup illustrated in FIG. 1 attached with a toothbrush.
Figure 3:
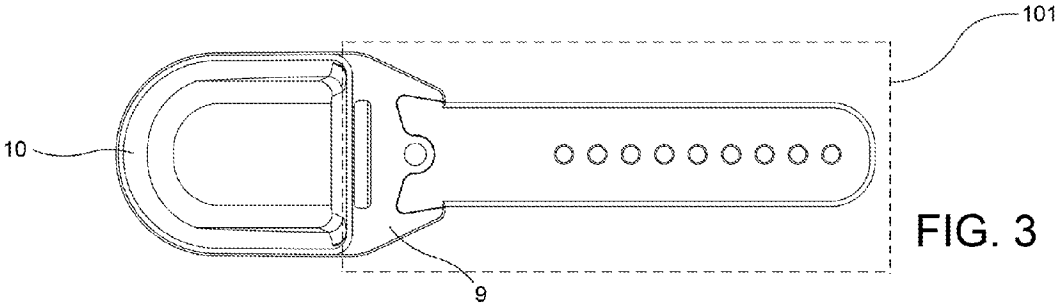
FIG. 3 is a top view showing the attachable cup illustrated in FIG. 1.
Figure 6:
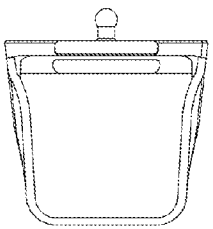
FIG. 6 is a rear elevation showing the attachable cup illustrated in FIG. 1.

An attachable cup for toothbrush shown in FIG. 8C is attached to a toothbrush with using a strap 50 instead of the strap 2 shown in FIG. 1. The strap 50 includes locking steps 51 and the container 1 includes a stopper 52, which acts as an locking mechanism in order to attach the attachable cup to a toothbrush with the locking steps 51. The stopper 52 also works as a lock releaser. The attachable cup is attachable by locking and so the attachable way is referred as a locking method and an attachable device 803 attaches the attachable cup to a toothbrush with the locking method.

Needless to say, although the present invention has been explained with a fastening method, a gripping method, a clamping method and a locking method, it is not desired to limit the attaching method to the exact construction, operation and embodiment shown and described. With that said, those skilled in the art will acknowledge that different adaptations and modifications of the described preferred embodiment can be constructed without abandoning from the scope of the invention.

By using an attachable cup for toothbrush of the present invention, it is easy for user to rinse his or her mouth without using a conventional drinking cup, wetting their hand, or place their head close to the faucet. The attachable cup can also be used continuously regardless of the lifetime of the toothbrush.

The invention claimed is:

1. An attachable cup for toothbrush comprising:
a container; and
an attachable device for toothbrush;
wherein said attachable device includes at least one part of said container for attaching,
wherein said attachable device comprising a strap with locking steps and a member for fastening and then locking said strap,
wherein said member is part of said container.

2. An attachable cup for toothbrush comprising:
a container; and
an attachable device for toothbrush;
wherein said attachable device includes at least one part of said container for attaching,
wherein said attachable device comprising a top extruding arm and a bottom extruding arm,
wherein said top extruding arm and said bottom extruding arm is part of said container,
wherein total number of said top extruding arm and said bottom are more than or equal to 3.

3. An attachable cup for toothbrush comprising;
a container including an extension arm, and
a strap connected with said container and including at least one hole,
wherein said extension arm is including an insert hole; width of which is wider than the width of said strap, a member for hooking with one of said holes.

4. An attachable cup for toothbrush according to claim 3, wherein said strap is made of silicone rubber.

5. An attachable cup for toothbrush according to claim 3, wherein capacity of said container is more than or equal to 5 ml and less than or equal to 90 ml.

* * * * *